US010376081B2

(12) United States Patent
Bateman

(10) Patent No.: US 10,376,081 B2
(45) Date of Patent: Aug. 13, 2019

(54) CUP HOLDERS

(71) Applicant: Alison Bateman, Surrey (GB)

(72) Inventor: Alison Bateman, Surrey (GB)

( * ) Notice: Subject to any disclaimer, the term of this patent is extended or adjusted under 35 U.S.C. 154(b) by 386 days.

(21) Appl. No.: 15/303,681

(22) PCT Filed: Apr. 17, 2015

(86) PCT No.: PCT/GB2015/051170
§ 371 (c)(1),
(2) Date: Oct. 12, 2016

(87) PCT Pub. No.: WO2015/159102
PCT Pub. Date: Oct. 22, 2015

(65) Prior Publication Data

US 2017/0027355 A1 Feb. 2, 2017

(30) Foreign Application Priority Data

Apr. 17, 2014 (GB) ..... 1406978.5

(51) Int. Cl.
*A47G 23/02* (2006.01)
*B65D 25/28* (2006.01)

(52) U.S. Cl.
CPC ..... *A47G 23/0216* (2013.01); *B65D 25/2876* (2013.01)

(58) Field of Classification Search
CPC ..... B65D 25/32; B65D 25/28; B65D 3/28; B65D 81/3869; B65D 25/2876; A47J 45/071; A47J 45/077; A47J 45/10; A47G 23/0216; A47G 1/17; A47G 23/0241; A47G 23/0208; A47G 7/047; F16B 47/00; A61M 5/1417; G09F 3/10; A45F 2005/1073; A45F 2005/1013; A45F 5/10
USPC ..... 294/31.2
See application file for complete search history.

(56) References Cited

U.S. PATENT DOCUMENTS

| | | | | | |
|---|---|---|---|---|---|
| 2,194,898 | A | * | 3/1940 | Hanford | B65D 25/2817 229/117.09 |
| 3,402,910 | A | | 9/1968 | Purvis | |
| 3,623,633 | A | * | 11/1971 | Kinn | B65D 25/2876 215/398 |
| 3,709,544 | A | | 1/1973 | Oltmanns | |
| 4,022,416 | A | * | 5/1977 | Kaye | A61M 5/1417 24/301 |
| 4,763,833 | A | * | 8/1988 | Stoll | B65D 5/2047 217/125 |
| 5,135,125 | A | * | 8/1992 | Andel | A61M 5/1417 215/12.1 |

(Continued)

FOREIGN PATENT DOCUMENTS

| | | | | |
|---|---|---|---|---|
| GB | 2078500 | A | | 1/1982 |
| GB | 2502147 | A | | 11/2013 |
| JP | 2005-74087 | A | * | 3/2005 |

*Primary Examiner* — Stephen A Vu
(74) *Attorney, Agent, or Firm* — Maschoff Brennan

(57) ABSTRACT

A cup holder comprises a single elongate strip (2) of flexible sheet material. One end (4) of the strip (2) is connected to the remainder of the strip at a first connection region (18) between its ends to form a collar (24), which extends, in use, around and engages the outer surface of a cup. The other end (6) of the strip (2) is connected to the collar (24) at a second connection region (20) opposite to the first connection region to form a handle (22) connected to the collar.

9 Claims, 8 Drawing Sheets

(56) References Cited

U.S. PATENT DOCUMENTS

| | | | | |
|---|---|---|---|---|
| 5,826,503 | A * | 10/1998 | Hutchinson | B29C 65/18 100/320 |
| 2014/0021730 | A1 | 1/2014 | Miwa | |

* cited by examiner

CUP HOLDERS

CROSS-REFERENCE TO RELATED APPLICATIONS

This application is a U.S. National Stage of PCT Application No. PCT/GB2015/051170, filed Apr. 17, 2015, which claims the benefit of GB Application No. 1406978.5, filed Apr. 17, 2014, both of which are incorporated herein by reference in their entireties.

BACKGROUND

The present invention relates to cup holders, that is to say to holders for beverage cups. The invention is particularly concerned with holders for beverage cups of the type which are of upwardly divergent frusto-conical shape and these are typically made of waxed paper or card and are commonly used in cafes and the like for the sale of beverages, particularly hot beverages, such tea, coffee, soup or noodles etc., for consumption on or off the premises.

Such cups are very advantageous because they are cheap and effective and they can readily be formed into nested stacks and thus require relatively little storage space. They are also biodegradable, in contrast to cups made of plastic material. However, they are not very easy to carry due to the fact that they are flexible and structurally weak and spillages therefore frequently occur. This problem is exacerbated when the beverage to be served is hot because the thermal insulation properties of such cups are relatively poor. Purchasers therefore frequently burn their fingers when carrying such cups filled with the hot beverage and this is not only uncomfortable but also increases the problem of spillages occurring.

In order to obviate these problems, it is known to use a holder or tray of folded/pulped cardboard material, which defines a number of recesses for accommodating cups. This largely obviates the problem of burning one's fingers when the cups are filled with a hot beverage but some trays have to be manually folded from flat cardboard blanks and this is quite time-consuming Further more, the tray blanks have to be stored and many retail outlets simply do not have the storage space available for such relatively bulky articles. Finally, the trays are generally disposed of after being used only once and this means that they add considerably to the overhead expenses of the retail outlet in question and also represent an unacceptable environmental burden in that they must all be subsequently disposed of in a landfill or alternatively recycled.

The above problems are at least partially overcome by the cup holder disclosed in GB2471872. This cup holder comprises a collar and a handle and the collar is a continuous loop of flexible sheet material in which two opposed holes are formed and which, in use, extends around and engages the outer surface of a cup. The handle comprises an elongate strip of flexible sheet material, integral with each end of which are two elongate lugs which extend divergently. The maximum distance between the outer edges of the lugs is greater than the maximum dimension of the holes in the direction of the length of the collar. The width of each lug is less than the said maximum dimension of the holes. The two ends of the handle are pivotally received in respective holes with the two lugs on one side of the collar and the adjacent portion of the handle being on the other side of the collar. Such a cup holder is associated with a considerable advantage by comparison with the known holder or tray referred to above, not least because it is considerably less bulky and therefore occupies very much less storage space and maybe disposed of more simply and cheaply. However, this known cup holder comprises two separate components and these have to be assembled. This is done by folding one of the lugs at each end of the handle over onto the other lug, passing the two lugs together through the associated hole in the collar and then unfolding the two lugs. The fact that the width of the two lugs in the unfolded state is greater than the diameter of the whole means that the handle is pivotally retained on the collar. However, the assembly process must in general be performed in the retail outlet, this is to say only shortly before the cup holder is used, because it is not preferable to store such cup holders in an assembled state.

It is therefore the object of the present invention to provide a cup holder which can be provided in an assembled and ready to use state, thereby saving time for the retailer or the like and it is a further object to provide such a cup holder which comprises only a single piece of material.

SUMMARY

According to the present invention a cup holder comprises a single elongate strip of flexible sheet material, one end of the strip being connected to the remainder of the strip at a first connection region between its ends to form a collar, which extends, in use, around and engages the outer surface of a cup, the other end of the strip being connected to the collar at a second connection region opposite to the first connection region to form a handle connected to the collar, first and second pre-formed transverse fold lines extending transversely to the length of the strip, preferably substantially perpendicular to the length of the strip, being formed in the handle adjacent the first and second connection regions, respectively, and first and second pre-formed oblique fold lines extending obliquely to the length of the strip, preferably at substantially 45° to the length of the strip, being formed in the handle and extending from one side edge of the handle adjacent one end of the first and second transverse fold lines, respectively, to the other side edge of the handle.

Accordingly, in the cup holder of the present invention, each end portion of the handle is provided with a pre-formed fold line extending transversely to the length of the handle and a further pre-formed fold line extending obliquely to the length of the handle. The transverse fold lines are preferably formed immediately adjacent the two connection regions and these lines therefore preferably extend substantially parallel to the plane of the collar. The oblique fold lines extend from a position at or very close to one end of the adjacent transverse fold line at an angle which is preferably substantially 45° to the length of the strip and of the handle to a point on the other side of the handle and spaced from the collar. The term "pre-formed fold line" is used herein to indicate a line of weakness along which the handle will fold when appropriate force is applied to it. The presence of a line of weakness will result in a reduced bending strength along the line and this means that when a force is applied to the handle it will inherently bend at the pre-formed lines and not elsewhere.

In the preferred embodiment there are two fold lines at each end of the handle, namely a transverse fold line, which preferably extends at about 90° to the length of the handle, and an oblique fold line, which preferably extends about 45° to the length of the handle. However, in a further embodiment, the transverse fold line extends at e.g. 60° to 80° to the length of the handle and the oblique fold line extends at 15° to 35° to the length of the handle. In this event, it is found that ready folding of the handle permitting it to move between the operative and inoperative positions is facilitated if there is a further preformed fold line at each end of the handle, which extends across the width of the handle between the transverse and oblique fold lines starting from or near to the position where the transverse and oblique fold lines meet the edge of the handle. It is preferred that this fold line extends along a line which substantially bisects the angle between the transverse and oblique fold lines.

Accordingly, the cup holder in accordance with the invention inherently has two different configurations, namely an inoperative configuration and an operative configuration. In the inoperative configuration, the handle overlies the collar and extends parallel to it and the cup holder, which will inherently be of generally elongate rectangular shape, may be folded flat and will thus occupy a minimum of space. In this inoperative configuration, the handle is flat and not bent at the four fold lines. If it is desired to move the cup holder from the inoperative configuration to the operative configuration, the collar is grasped with one hand and with the other hand the user exerts an upward force on the free end of the handle. The handle will then rotate about the two connection regions until the direction of its length is perpendicular to that of the collar. In this state, the handle will be bent through substantially 180° at each of the fold lines. Coffee cups and the like are generally of progressively increasing cross-sectional area in the upward direction and the size of the collar is selected such that it has a diameter between the maximum and minimum diameters of the cup which it is desired to hold when the cup holder is in the inoperative configuration, the collar is opened with one hand and the lower end of a cup is then inserted into the opening defined by the annular collar and the collar is then moved upwardly until it reaches the height at which the diameter of the cup is equal to that of the collar. The handle is then moved into the operative configuration and the cup may then be carried and lifted by means of the handle. If it is desired to return the cup holder to the inoperative configuration, a sideways and downwards force is exerted on the free end of the handle, which then rotates downwardly about the connection regions, accompanied by relative rotational movement of those portions of the handle on opposite sides of each pre-formed fold line. It is found in practice that the resilience of the strip material of the handle is such that the handle is quasi-bistable, that is to say the handle is an equilibrium when in either the operative or inoperative configuration but when positioned between the operative and inoperative configurations the inherent elasticity of the material will urge the handle into the closest of the operative and inoperative configurations.

The fact that the handle is movable between operative and inoperative positions is associated with two quite different advantages. The first is that whilst a cup holder will always be used with a handle in the operative position, when it is in the inoperative position the handle is more compact and thus easier to store. Secondly, when the handle is in the operative position it is not readily possible to insert a beverage cup into it, at least without tilting the cup to an angle which will run the risk of spilling the contents of the cup, whereas once the handle has been moved to the inoperative position, a cup may readily be inserted into the collar, whereafter the handle is returned to its operative position to allow it to be used to carry the cup. A further advantage is that one can simply drink from the cup with the handle around its outer periphery by moving the handle from the operative position to the inoperative position.

Optionally, the strip has a curved portion at one end, said curved portion including said end of the strip being connected to the remainder of the strip at said first connection region between its ends to form said collar, which collar has a tapered internal diameter.

Optionally, the diameter of the collar is smaller at a base of said collar than at a top of said collar.

The tapering diameter of the collar advantageously allows a cup to be more readily inserted (and removed) into the collar due to the diameter at the top edge being larger than at the bottom edge. The tapering surface can also provide a greater contact and support area and can also provide an improved fit with the external surface of a cup placed therein, particularly a cup with a tapering external profile, such a cup with an upwardly divergent frusto-conical shape.

The fact that the cup holder is made from a single elongate strip of flexible sheet material and is thus of substantially elongate rectangular shape is also associated with two very substantial advantages. Firstly, a large number of handles may be cut from a single sheet of flexible material, e.g. card, cardboard or even plastic material, with virtually no wastage. Furthermore, the fact that the strip is of substantially elongate rectangular shape means that it is inherently possible to manufacture a large number of cup holders at the same time from a single sheet of flexible material, that is to say to form the necessary connections, e.g. by means of adhesive, whilst the strips are connected together. However, the manufacturing process may include substantially separating adjacent strips whilst leaving two or more readily frangible links or bridges connecting them together and this means that a number of cup holders may be stored connected together as a single assembly and when it is desired to use a cup holder it may be torn off the assembly and used whilst leaving the remaining cup holders of the set still connected together. Thus a further aspect of the present invention relates to a plurality or set of cup holders of the type referred to above in folded flat form side by side, the elongate strip of each cup holder being connected to the elongate strip of the or each adjacent cup holder by two or more frangible bridges. This further reduces wastage of the sheet material during the manufacturing process.

The collar and handle may be made of a number of different flexible sheet materials but a particularly cheap and effective material is stiff paper or card. The pre-formed fold lines may also take a number of different forms and one possibility is that they constitute a line of perforations or alternatively a line of slits extending through or at least partially through the handle separated by lands of unsevered material. The pre-formed fold lines can also be constituted by creases formed in the handle since such creases will also constitute lines of weakness, that is to say lines of reduced bending strength. It is, however, found to be particularly effective if the fold lines are formed by cutting partially through the paper or card material from the outwardly facing surface along the line. Since the handle will inherently have a reduced bending strength along the lines of reduced thickness, when a force is applied to the handle it will bend along the pre-formed lines.

BRIEF DESCRIPTION OF THE DRAWINGS

Further features and details of the invention will be apparent from the following description of one specific embodiment, which is given by way of example only, with reference to the accompanying drawings, in which.

DETAILED DESCRIPTION

Figure 1:
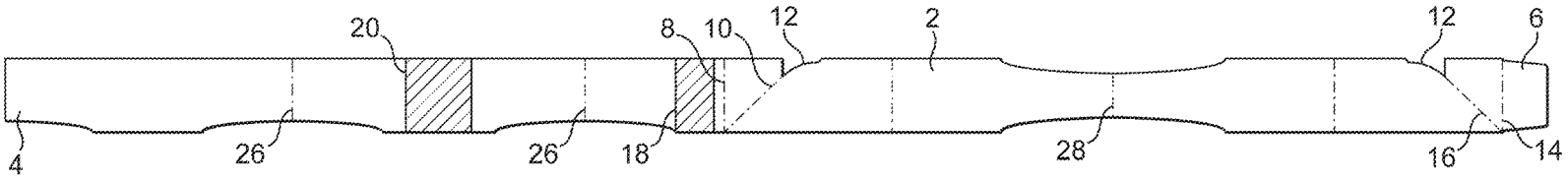
FIG. 1 is a plan view of the elongate strip of material from which a cup holder in accordance with the invention may be made.

FIG. 1 shows an elongate strip 2 of substantially rectangular shape of relatively stiff card. The strip 2 has two ends 4, 6. Formed in the strip are a number of pre-formed fold lines made e.g. by a cutting tool, stamp or the like. These include a first transverse fold line 8 extending perpendicular to the length of the strip at a position nearly half way along its length and a first oblique fold line 10, which extends at 45° to the length of the strip from its bottom edge, as seen in FIG. 1, at the position where the fold line 8 meets that edge to the opposite edge. It will be seen that a portion of the opposite edge is cut away at 12 at the position where the oblique fold line meets the opposite edge and whilst this cut away portion is not essential, it is found to be desirable to facilitate ready bending of the strip along the fold line 10. The strip 2 is also provided with a second transverse fold line 14 extending perpendicular to the length of the strip and positioned only a short distance of e.g. 10 to 20 mm from the right-hand end 6 of the strip. A further oblique fold line 16 extends at 45° to the length of the strip from its lower edge, at the position where the fold line 14 meets that edge, to the opposite edge. At the position where it meets the opposite edge there is a further cut out 12 to facilitate bending along the line 16. There are also certain further fold lines formed in the strip and these will be described below.

Figure 3:
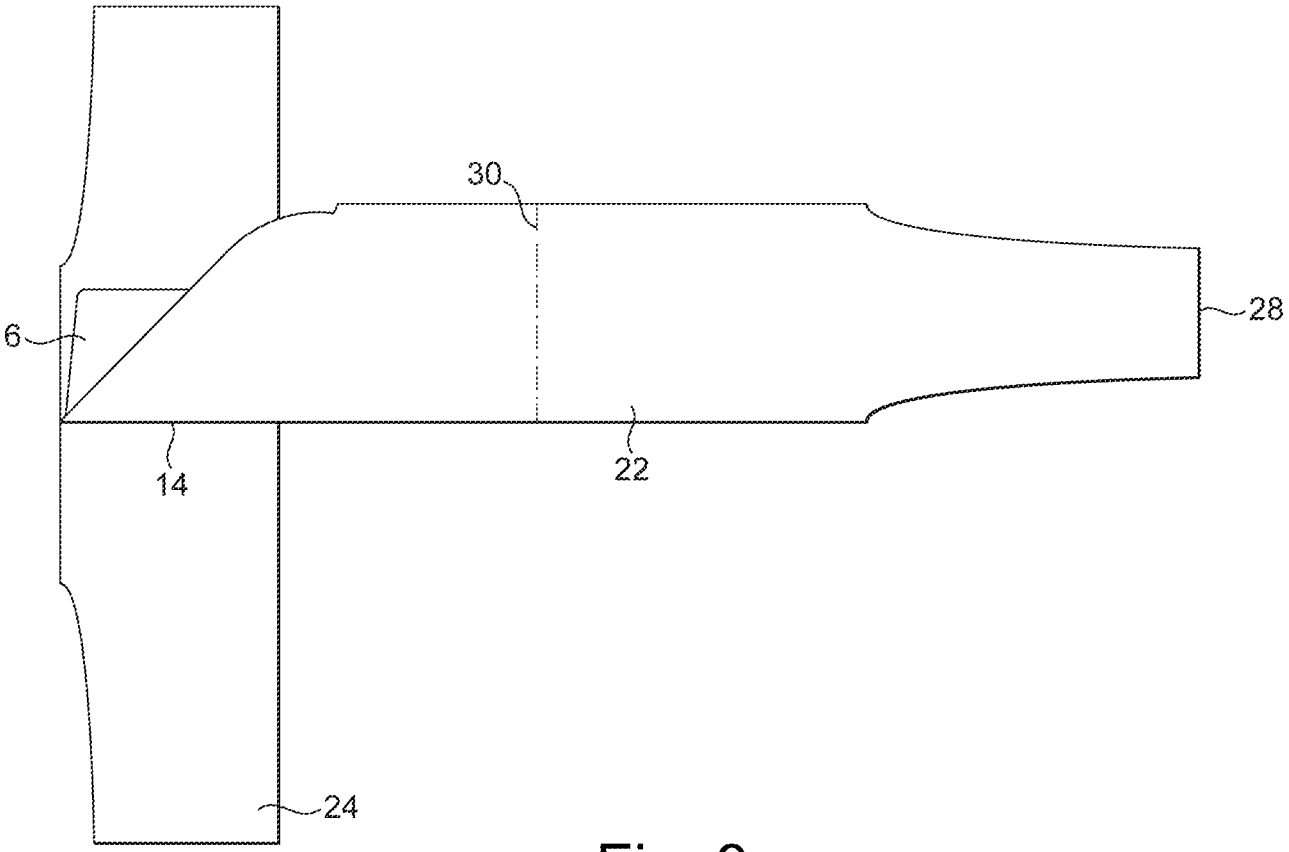
FIG. 3 is a side view of the cup holder in the operative configuration.

When the cup holder is to be assembled, the reverse side, as seen in FIG. 1, of the left-hand end 4 of the strip is connected, preferably by adhesive, to a region of the strip 18, referred to as a connection region, closely adjacent the first transverse fold line 8, thereby forming a closed annular portion of the strip, which constitutes a collar. The other end 6 of the strip is then bent over and secured, preferably by adhesive, to the external surface of the collar at a second connection region, which is on the reverse of the area 20 shown in FIG. 1 and is diametrically opposed to the connection region 18, when the collar adopts a circular shape. The right-hand half of the strip 2, as seen in FIG. 1, then constitutes a loop secured to diametrically opposed regions 18 and 20 of the collar and may be used as a carrying handle. As best seen in FIG. 3, the handle is connected slightly asymmetrically to the collar such that the two transverse fold lines 8 and 14, which are positioned substantially at one side edge of the associated connection region 18, 20 are diametrically opposed, when the collar adopts a circular shape. This ensures that the transmission of forces between the collar and the handle occurs along two lines which are symmetrical with respect to the collar. The cup holder is now complete and is in the inoperative configuration in which the length of the handle is parallel to the length of the collar, that is to say the loops or rings constituted by the collar and handle lie in the same plane.

Figure 2:
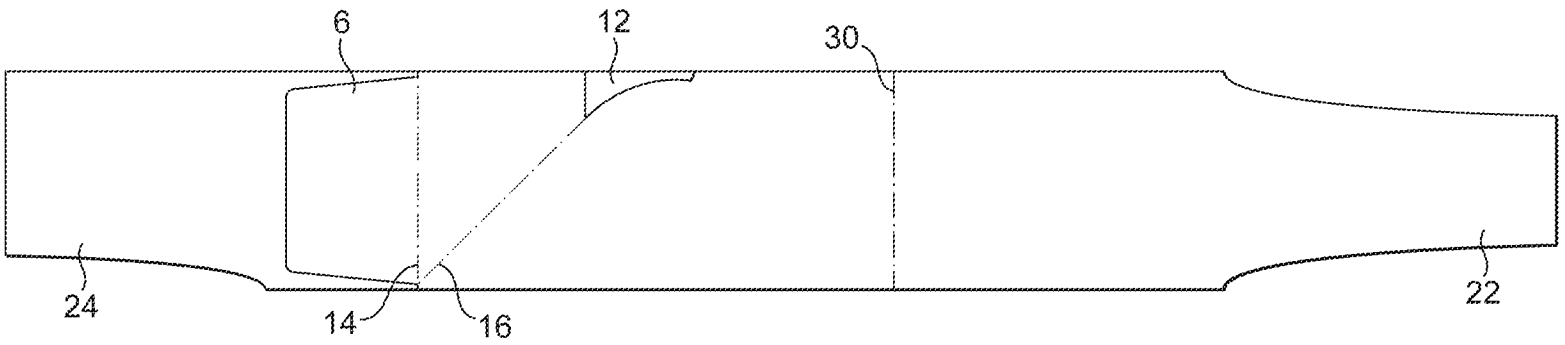
FIG. 2 is a plan view of the assembled cup holder in the inoperative configuration.
Figure 4:
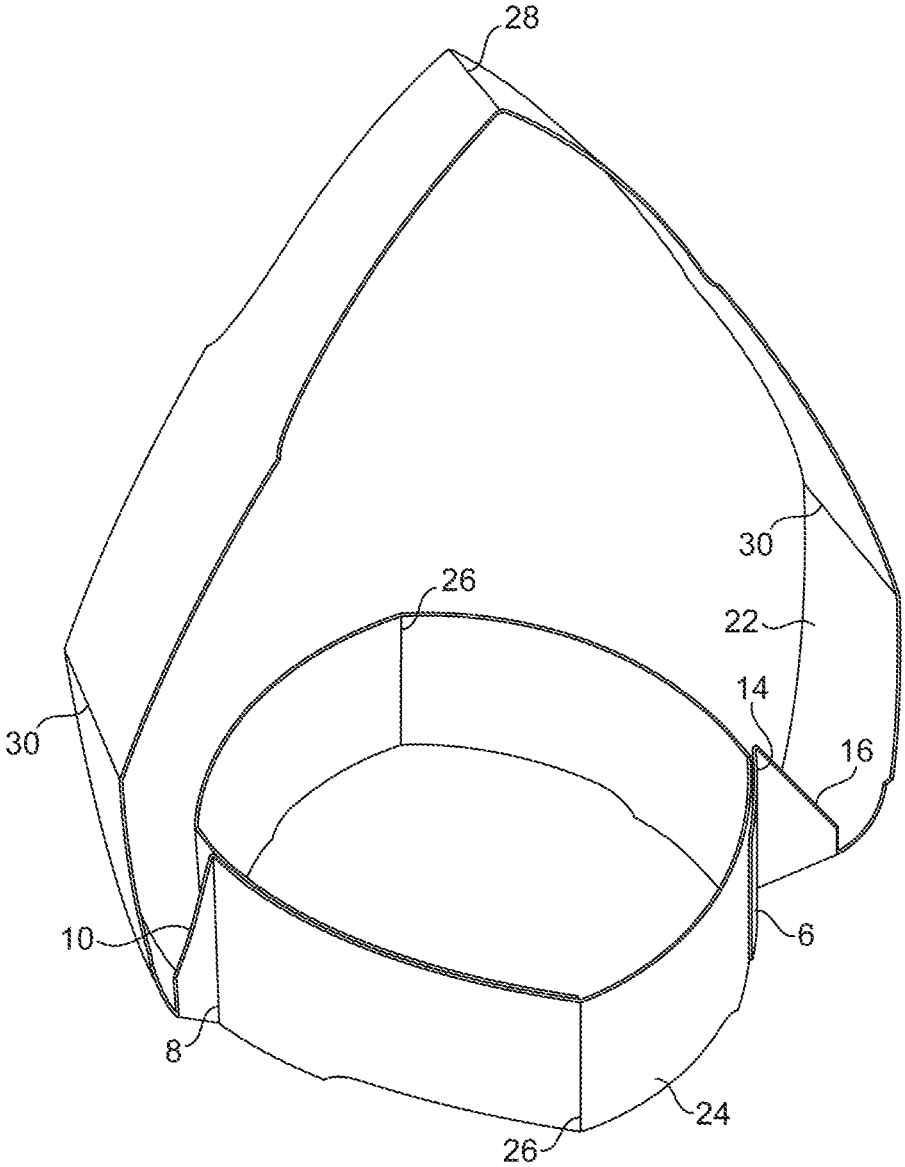
FIG. 4 is a perspective view of the cup holder in the operative configuration.

If it is desired to use the cup holder to carry a cup, the collar is opened by the user to form at least a roughly circular shape and the lower end of a cup is placed within it. In order then to carry the cup using the cup holder, the handle, which is designated 22 in FIG. 4, is raised upwardly. As it does so, rotation of the portions of the handle on each side of each fold line 8, 14, 12, 16 occurs. In the inoperative configuration of the cup holder, the handle is unbent about these four fold lines but as the handle is raised to the operative position shown in FIGS. 3 and 4, the strip bends or folds through 180° about each of these four fold lines and this folding movement permits the handle 22 to move from the inoperative position shown in FIG. 2, into the operative position, shown in FIGS. 3 and 4, in which it lies in a plane which extends perpendicular to the plane of the collar 24. If the handle is now lifted by a user, the collar 24 will slide up the cup until it reaches a height at which the external diameter of the cup is equal to the diameter of the collar and further upward movement is then prevented. Further lifting of the handle results in the collar 24 and thus the cup within it being lifted also. The weight of the cup is transmitted through the collar 24 to the handle 22 through the two transverse fold lines 8, 14 and these are positioned such that they are diametrically opposed to one another on the collar. If it is then desired to drink from the cup, the handle 22 is swung back again to the inoperative configuration and relative rotation then occurs again about the fold lines 8, 10, 14 and 16 until the collar and handle again lie in the same plane and the handle is no longer bent or folded about the fold lines. The cup may then be removed from the collar and the collar itself may be disposed of or re-used in the same manner.

When in the inoperative configuration, the cup holder is preferably maintained in a folded flat state so that it occupies the minimum space. In order to facilitate folding the cup holder flat, it is provided, in this specific embodiment, with two further fold lines 26 in the collar portion of the strip 2 which are situated, in the assembled collar, diametrically opposed to one another and offset from the two transverse fold lines 14, 8 by 90°. The strip is preferably also provided with yet a further fold line 28 which is positioned such that in the assembled cup holder it is situated at the apex of the loop constituted by the handle, that is to say midway along its length, because it is at this point that the handle will be folded when the cup holder is pushed into the fully folded inoperative configuration. When in this configuration, the handle is likely to extend significantly beyond the collar and it may be desirable in order to make the cup holder as small as possible for the handle to be folded back on itself at a position shortly beyond the end of the collar so that it overlies the collar. In order to facilitate this, the strip 2 is conveniently provided with two yet further pre-formed fold lines 30 situated symmetrically part-way along the length of the handle from its two ends at which it is connected to the collar.

Figure 5:
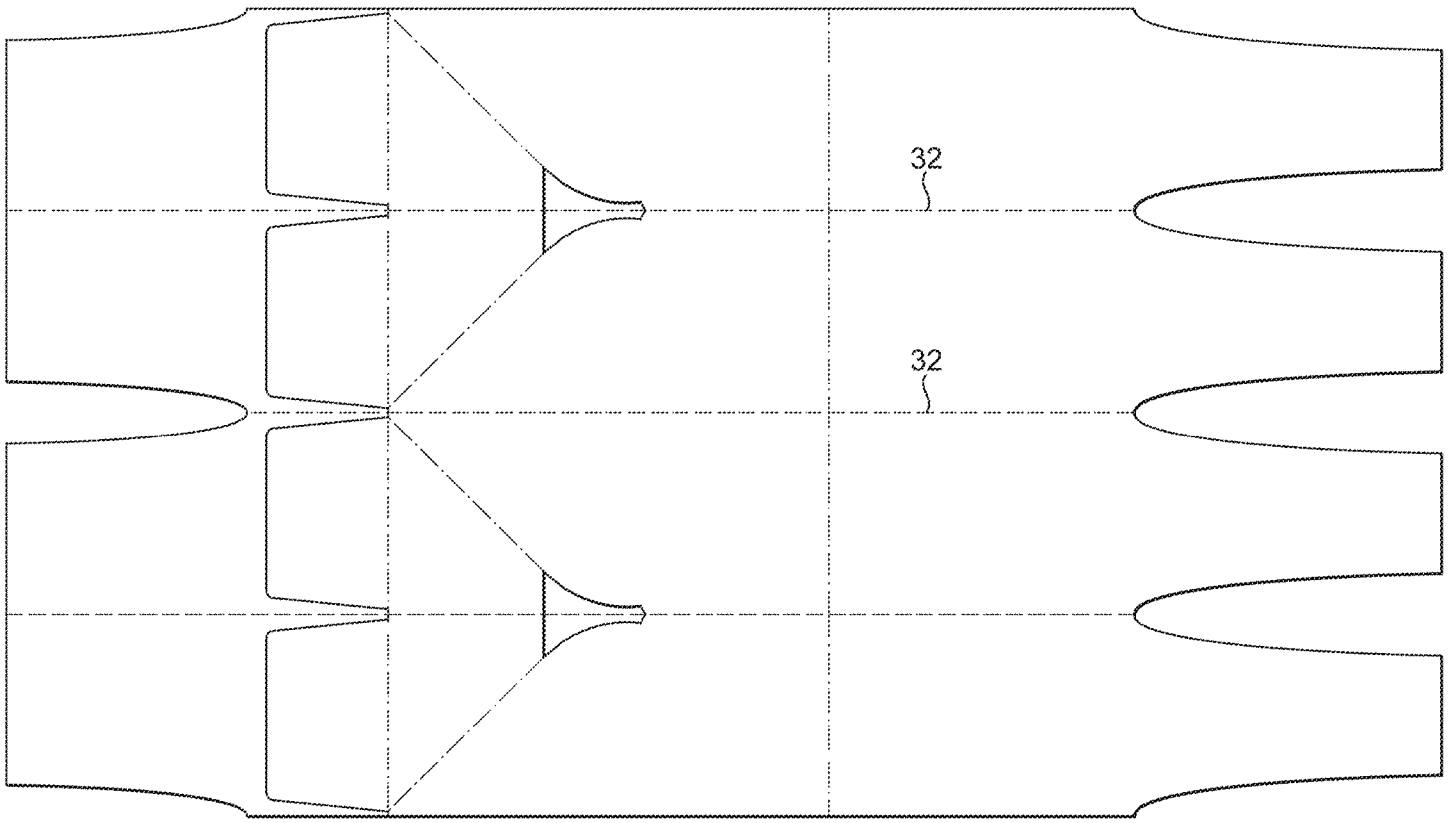
FIG. 5 is a plan view of a unit consisting of a number of cup holders in the inoperative configuration connected together.

The above description does of course relate to the production of a single cup holder but it is more practical and economical if a substantial number of cup holders are manufactured at the same time from a larger sheet of card. FIG. 5 shows four cup holders connected together to form a unit but in practice the number of cup holders that are manufactured at the same time is likely to be very much larger than this. Thus a relatively large sheet of card material may be bent in the appropriate manner and the appropriate glued connections effected and an appropriate tool may be used to form the various pre-formed fold lines and to substantially sever or separate the individual cup holders, leaving them connected only by two or more integral, frangible bridges 32. If it is desired to use a cup holder, one may simply be manually torn off the assembly of cup holders and then used in the manner described above. As may be seen in FIG. 5, each alternate cup holder in the unit is rotated through 180° about its longitudinal axis with respect to the or each adjacent cup holder. This has the effect of bringing the cut away portions 12 in adjacent cup holders into registry, which facilitates the production of the cut away portions during the manufacturing process.

Figure 6:
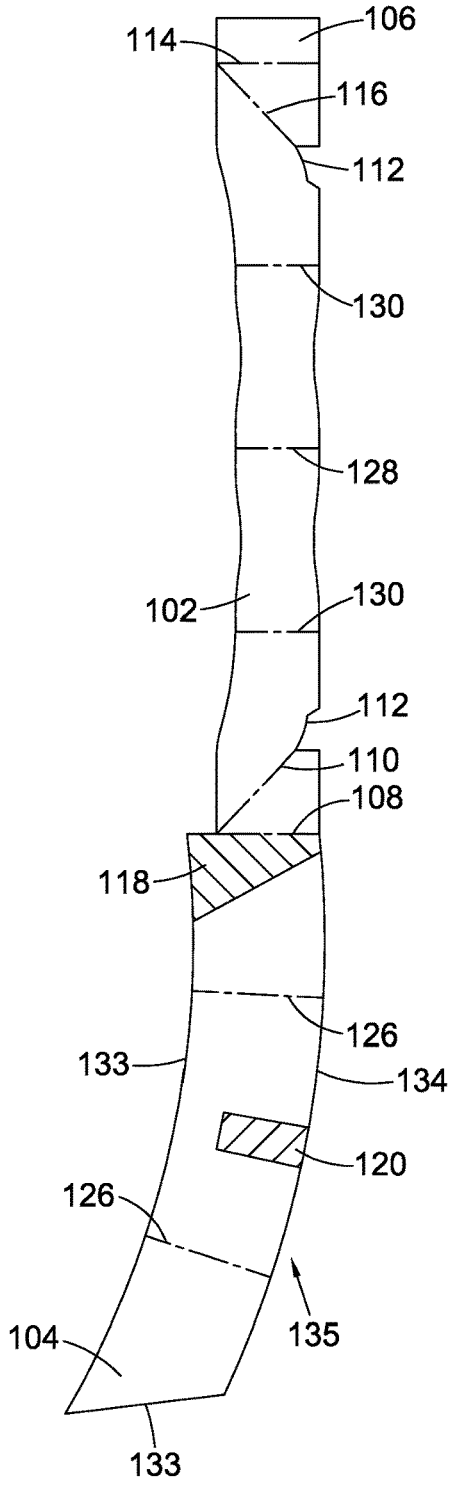
FIG. 6 is a plan view of the elongate strip of material from which an alternative cup holder in accordance with the invention may be made.

FIG. 6 shows a further example of an elongate strip 102 used to form a cup holder. The strip 102 is similar to the example of FIG. 1 and has two ends 104, 106. Formed in the strip are a number of pre-formed fold lines made e.g. by a cutting tool, stamp or the like. These include a first transverse fold line 108 extending generally perpendicular to the length of the strip at a position nearly half way along its length and a first oblique fold line 110, which extends at 45° to the length of the strip from its bottom edge, as seen in FIG. 6, at the position where the fold line 108 meets that edge to the opposite edge. It will be seen that a portion of the opposite edge is cut away at 112 at the position where the oblique fold line meets the opposite edge and, as with the example of FIG. 1, whilst this cut away portion is not essential, it is found to be desirable to facilitate ready bending of the strip along the fold line 110. The strip 102 is also provided with a second transverse fold line 114 extending perpendicular to the length of the strip and positioned only a short distance of e.g. 10 to 20 mm from the end 106 of the strip. A further oblique fold line 116 extends at 45° to the length of the strip from its lower edge, at the position where the fold line 114 meets that edge, to the opposite edge. At the position where it meets the opposite edge there is a further cut out 112 to facilitate bending along the line 116. There are also certain further fold lines formed in the strip and these will be described below.

The portion 135 of the elongate strip 102 to the left of the fold line 108, i.e. the end towards the bottom of the page of FIG. 6, is curved along opposing first and second edges 133, 134, with the edges being substantially parallel to one another. The portion 135 has an end edge 133 extending at an angle between the first and second edges.

The cup holder is assembled similarly to the example of FIG. 1. When the cup holder is to be assembled, the left-hand end 104 of the strip is connected, preferably by adhesive, to a region 118 on the rear, as seen in FIG. 6, of the strip 102, referred to as a connection region, closely adjacent the first transverse fold line 108, thereby forming a closed annular portion of the strip, which constitutes a collar. Due to the curved edges of the lower portion 135, the collar forms a tapering collar, such that the diameter of the collar is smaller towards its base as is visible in FIGS. 7 and 8. This form can be described as an upwardly divergent frusto-conical shape.

The other end 106 of the strip is then bent over and secured, preferably by adhesive, to the external surface of the collar at a second connection region, which is in the area 120 shown in FIG. 6 and is diametrically opposed to the connection region 118, when the collar adopts a circular shape. The right-hand half of the strip 102, i.e. the end towards the top of the page as seen in FIG. 6, then constitutes a loop secured to diametrically opposed regions 118 and 120 of the collar and may be used as a carrying handle.

Figure 8:
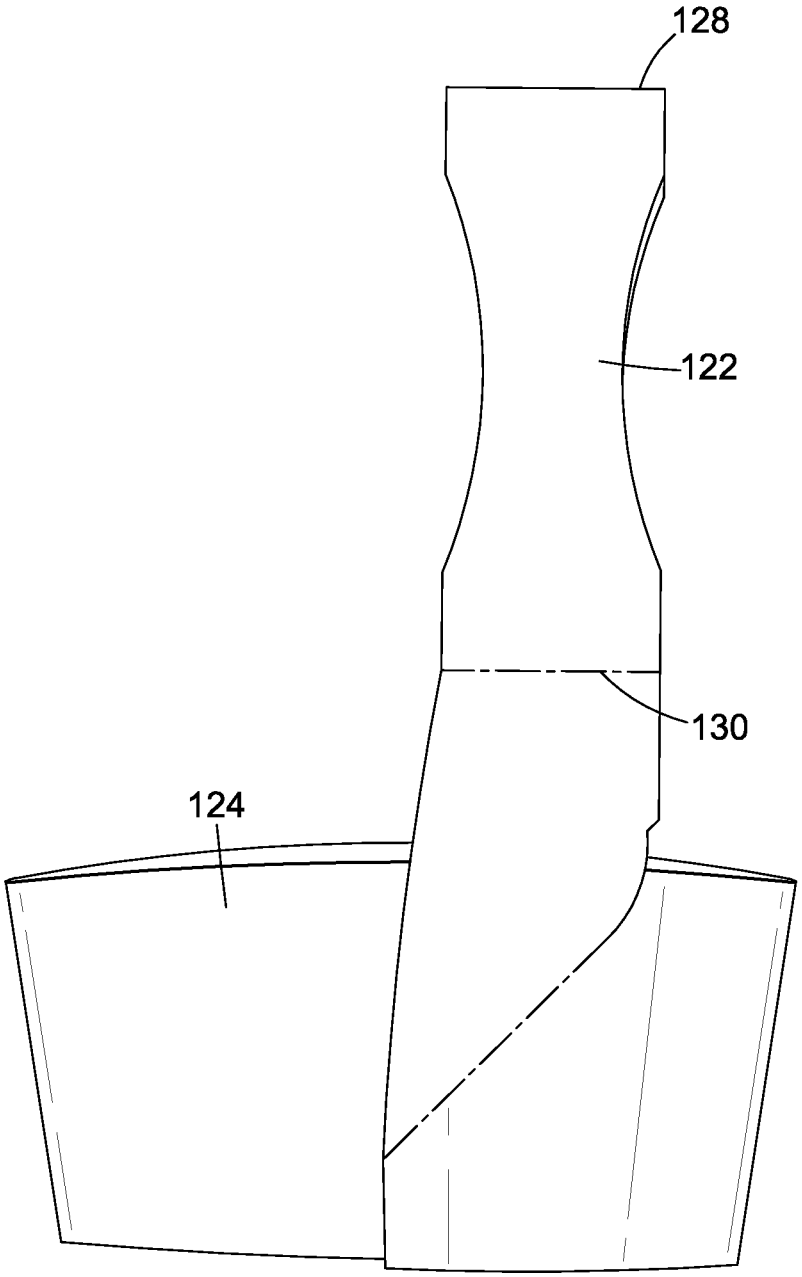
FIG. 8 is a side view of the cup holder in an operative configuration.

Similarly to the example of FIG. 1 and as best seen in FIG. 8, the handle, of which one half is visible in FIG. 8, is connected slightly asymmetrically to the collar such that the two transverse fold lines 108 and 114, which are positioned substantially at one side edge of the associated connection region 118, 120 are diametrically opposed, when the collar adopts a circular shape. This ensures that the transmission of forces between the collar and the handle occurs along two lines which are symmetrical with respect to the collar. The cup holder is now complete and is in the inoperative configuration in which the length of the handle is parallel to the length of the collar, that is to say the loops or rings constituted by the collar and handle lie in the same plane.

As with the example of FIG. 1, if it is desired to use the cup holder to carry a cup, the collar is opened by the user to form at least a roughly circular shape and the lower end of a cup is placed within it. The tapering diameter of the collar advantageously allows a cup to be more readily inserted (and removed) into the collar due to the diameter at the top edge being larger than at the bottom edge. The tapering surface can also provide a greater contact and support area and can also provide an improved fit with the external surface of a cup placed therein, particularly a cup with a tapering external profile, such as a cup with an upwardly divergent frusto-conical shape.

Figure 7:
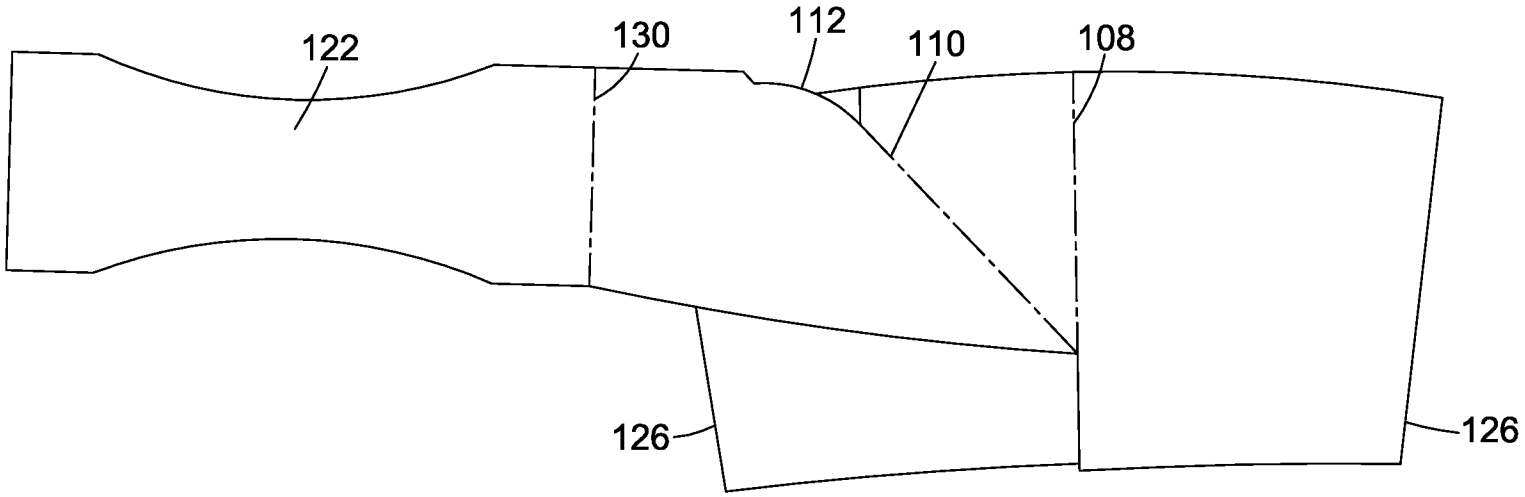
FIG. 7 is a plan view of the assembled cup holder in an inoperative configuration.

In order then to carry the cup using the cup holder, the handle, which is designated 122 in FIGS. 7 and 8, is raised upwardly. As it does so, rotation of the portions of the handle on each side of each fold line 108, 110, 114, 116 occurs.

As with the example of FIG. 1, in the inoperative configuration of the cup holder, the handle is unbent about these four fold lines but as the handle is raised to the operative position shown in FIGS. 7 and 8, the strip bends or folds through 180° about each of these four fold lines and this folding movement permits the handle 122 to move from the inoperative position shown in FIG. 7, into the operative position, shown in FIG. 8, in which it lies in a plane which extends perpendicular to the plane of the collar 124. If the handle is now lifted by a user, the collar 124 will slide up the cup until it reaches a height at which the external diameter of the cup is equal to the diameter of the bottom of the collar and further upward movement is then prevented.

Further lifting of the handle results in the collar 124 and thus the cup within it being lifted also. The weight of the cup is transmitted through the collar 124 to the handle 122 through the two transverse fold lines 108, 114 and these are positioned such that they are diametrically opposed to one another on the collar. If it is then desired to drink from the cup, the handle 122 is swung back again to the inoperative configuration and relative rotation then occurs again about the fold lines 108, 110, 114 and 116 until the collar and handle again lie in the same plane and the handle is no longer bent or folded about the fold lines. The cup may then be removed from the collar and the collar itself may be disposed of or re-used in the same manner.

As with the example of FIG. 1, when in the inoperative configuration, the cup holder is preferably maintained in a folded flat state so that it occupies the minimum space. In order to facilitate folding the cup holder flat, it is provided, in this specific embodiment, with two further fold lines 126 in the collar portion of the strip 102 which are situated, in the assembled collar, diametrically opposed to one another and offset from the two transverse fold lines 114, 108 by 90°. The strip is preferably also provided with yet a further fold line 128 which is positioned such that in the assembled cup holder it is situated at the apex of the loop constituted by the handle, that is to say midway along its length, because it is at this point that the handle will be folded when the cup holder is pushed into the fully folded inoperative configuration. When in this configuration, the handle is likely to extend significantly beyond the collar and it may be desirable in order to make the cup holder as small as possible for the handle to be folded back on itself at a position shortly beyond the end of the collar so that it overlies the collar. In order to facilitate this, the strip 102 is conveniently provided with two yet further pre-formed fold lines 130 situated symmetrically part-way along the length of the handle from its two ends at which it is connected to the collar.

Similarly to the example of FIG. 1, a substantial number of cup holders can be manufactured at the same time from a larger sheet of card.

What is claimed is:

1. A cup holder comprising a single elongate strip of flexible sheet material, a first end of the strip being connected to a remainder of the strip at a first connection region between ends thereof to form a collar, which extends, in use, around and engages an outer surface of a cup, a second end of the strip being connected to the collar at a second connection region opposite to the first connection region to form a handle connected to the collar, first and second pre-formed transverse fold lines extending transversely to a length of the strip being formed in the handle adjacent the first and second connection regions, respectively, and first and second pre-formed oblique fold lines extending obliquely to the length of the strip being formed in the handle and extending from a first side edge of the handle adjacent one end of the first and second transverse fold lines, respectively, to a second side edge of the handle and two additional pre-formed fold lines extending substantially perpendicular to the length of the strip are formed in the collar, which are opposed to one another and are each positioned substantially midway between the first and second connection regions.

2. The cup holder as claimed in claim 1 in which the first and second transverse fold lines extend substantially perpendicular to the length of the strip.

3. The cup holder as claimed in claim 1 in which the first and second pre-formed oblique fold lines extend at substantially 45° to the length of the strip.

4. The cup holder as claimed in claim 1 in which an additional pre-formed fold line extending substantially perpendicular to the length of the strip is formed substantially half way along a length of the handle.

5. The cup holder as claimed in claim 1 including two additional pre-formed fold lines extending substantially perpendicular to the length of the strip in the handle at positions which, when the cup holder is folded flat and a length of the handle is aligned with a length of the collar, are situated substantially in line with one end of the collar.

6. The cup holder as claimed in claim 1 in which the first and second transverse fold lines are substantially diametrically opposed on or adjacent a periphery of the collar, when the collar adopts a circular shape.

7. The cup holder as claimed in claim 1, wherein the strip has a curved portion at one end, said curved portion including said end of the strip being connected to a remainder of the strip at said first connection region between ends thereof to form said collar, which collar has a tapered internal diameter.

8. The cup holder as claimed in claim 7, wherein a diameter of the collar is smaller at a base of said collar than at a top of said collar.

9. A plurality of cup holders as claimed in claim 1 in folded flat form side by side, the elongate strip of each cup holder being connected to the elongate strip of the or each adjacent cup holder by two or more frangible bridges.

* * * * *